United States Patent [19]

Whipple et al.

[11] 4,141,208

[45] Feb. 27, 1979

[54] DIGITALLY TUNED TIMEPIECE

[75] Inventors: John N. Whipple, Santa Ana; Norman E. Moyer; Irving B. Merles, both of Newport Beach, all of Calif.

[73] Assignee: Hughes Aircraft Company, Culver City, Calif.

[21] Appl. No.: 650,335

[22] Filed: Jan. 19, 1976

[51] Int. Cl.[2] ..... G04C 3/00

[52] U.S. Cl. ..... 58/23 AC

[58] Field of Search ..... 58/23 R, 50 R, 85.5, 58/23 AC; 331/177 R

[56] References Cited

U.S. PATENT DOCUMENTS

| | | | |
|---|---|---|---|
| 3,768,247 | 10/1973 | Fujita | 58/23 R |
| 3,810,356 | 5/1974 | Fujita | 58/85.5 |
| 3,834,152 | 9/1974 | Nishimura et al. | 58/85.5 |
| 3,852,951 | 12/1974 | Sauthier | 58/23 R |
| 3,871,168 | 3/1975 | Maire et al. | 58/23 R |
| 3,895,486 | 7/1975 | Hammer et al. | 58/23 R |
| 3,916,612 | 11/1975 | Morokawa et al. | 58/23 R |
| 3,925,775 | 12/1975 | Gay | 58/50 R |
| 3,928,959 | 12/1975 | Naito | 58/85.5 |

*Primary Examiner*—James R. Scott
*Assistant Examiner*—Vit W. Miska
*Attorney, Agent, or Firm*—F. I. Konzem; W. H. MacAllister

[57] ABSTRACT

In a digital watch, frequency adjusting can be achieved by selectively deleting pulses at a specified location in the divider chain in order to obtain the desired time-keeping accuracy. When a digital watch's recessed (setting) push button is sequentially depressed, the watch's display advances through the month, date, hours and minutes/seconds setting modes. If the recessed push button is depressed again, the watch will be in the coarse frequency adjust mode and the letters "CFA" are shown on the watch display for approximately one second, the display is blanked for 0.5 second, and then the watch shows a three digit frequency correction number with the first two digits flashing. By holding down a main operating push button, the flashing number increments at a one Hertz rate until the desired coarse frequency correction number is shown on the watch display. An additional push of the recessed push button puts the watch in the fine frequency adjust mode and the letters "FFA" are shown on the watch display for approximately one second, the display is blanked approximately 0.5 seconds, and the same three digit frequency correction number appears with the last digit flashing. By holding down the main push button, the flashing digit is incremented at a one Hertz rate until the desired fine frequency correction number is obtained at which time the main push button is released.

8 Claims, 6 Drawing Figures

DIGITALLY TUNED TIMEPIECE

FIELD OF THE INVENTION

This invention relates to adjustable frequency means within a digital watch, and more particularly to frequency adjusting means which may be employed by a user to selectively alter the divisor of a divider chain within the digital watch.

DESCRIPTION OF THE PRIOR ART

In the art, the user of a digital watch was unable to adjust for errors in the frequency outputed by the crystal oscillator of the watch. Over the lifetime of a digital watch, errors occur in the frequency due to crystal aging, different average temperature of operation, and shock to the crystal from accidental causes. The frequency adjusting means of the present invention allows the user of the digital watch to increase or decrease the average pulse rate at a selected point in the divider chain thereby altering the timekeeping accuracy.

SUMMARY OF THE INVENTION

The frequency adjusting means, in accordance with the invention, consists of a crystal oscillator, high frequency divider, lower frequency divider, setting logic with a plurality of push buttons, a timer, and a digital tuner. When the recessed button is sequentially depressed, the setting logic advances through the month, date, hours, and minutes/seconds setting modes. With another push of this push button, the digital watch is put in the coarse frequency adjust mode. The timer circuit which is connected to the setting logic causes the letters "CFA" which stand for coarse frequency adjust to be displayed on the digital watch display for one second, then the display is blanked for 0.5 seconds. The frequency correction number, a three digit number, is then displayed with the first two digits flashing. When the second or main push button is depressed, the coarse portion of the frequency correction number (the flashing portion) is incremented at a one Hertz rate. The digital tuner utilizes the correction number to cause the deletion of a specific number of pulses per fixed time interval at a particular point in the divider chain. If the recessed push button is depressed again, the watch will be placed in the fine frequency adjust mode and the letters "FFA" which stand for fine frequency adjust will be displayed on the watch's display for one second, then the display blanked for 0.5 seconds. The frequency correction number will then reappear with the last digit flashing. Depression of the main push button then causes the fine frequency correction number to be incremented at a one Hertz rate until the correct number is obtained at which time the main push button is released. A final push of the recessed button returns the watch to the normal state.

Accordingly, it is an object of this invention to provide frequency adjusting means in a digital watch which allows the user of the digital watch to correct for changes in the crystal oscillator frequency.

A further object is to reduce cost by elimination of components used to adjust the frequency of a crystal oscillator.

Yet another object is to reduce power consumption and optimize stability by letting the crystal oscillate at its natural frequency, rather than "pulling" it to a specified value.

The features of the present invention which are believed to be novel are set forth with particularity in the appended claims. The present invention, both as to its organization and manner of operation, together with further objects and advantages thereof, may be better understood by reference to the following description, taken in connection with the accompanying drawings.

DETAILED DESCRIPTION

Figure 1:
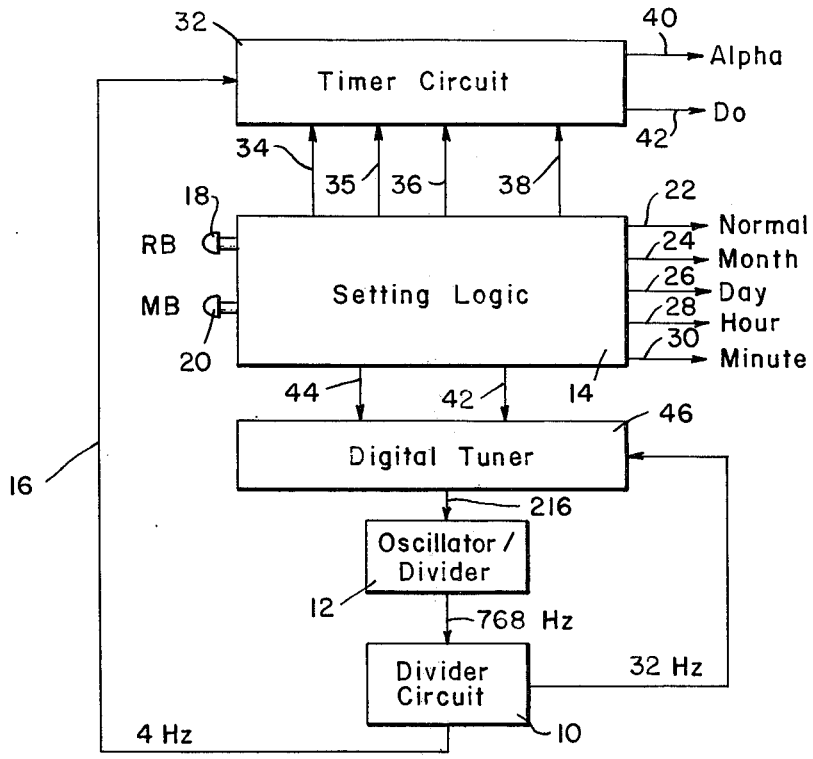
FIG. 1 is a block diagram of the frequency adjusting means in a digital watch of the present invention.

Referring now to FIG. 1, the lower frequency divider circuit 10 delivers a low frequency clock pulse to the timer logic 32 via line 16. The setting logic which is used to sequence the digital watch through the months, date, hours and minutes/seconds setting modes is controlled by a recessed push button 18 and a main push button 20. The horological information to be displayed and enabled for setting is determined by output lines 22–30. Normal operation occurs when line 22 is at logic 1. Months are selected by line 24, date by line 26, hours by line 28, and minutes by line 30. Push button signals are delivered from the setting logic 14 to the timer circuit 32 via lines 34 and 35. Line 34, corresponding to the recessed button, increments the timer circuit 32 to the next mode with each push. Setting logic 14 also delivers a fine tune enable (FT) signal via line 36 to the timer circuit 32. This fine tune enable signal causes display of the letters "FFA," which stand for fine frequency adjust. The setting logic 14 outputs a coarse tune enable (CT) signal via line 38 to the timer circuit 32. The coarse tune enable signal causes display of the letters "CFA" which stand for coarse frequency adjust on the digital watch's electro-optical display. The setting logic 14 delivers a slew coarse tune inverse ($\overline{SCT}$) signal via line 42 to the digital tuner 44. Finally, the setting logic 14 delivers a slew fine tune inverse ($\overline{SFT}$) signal via line 44 to the digital tuner 46.

The digital tuner 46 delivers a signal back to the high frequency oscillator/divider 12 telling it when to delete a pulse at the particular point in the divider chain where the deletion circuitry is built. A crystal oscillator is used whose frequency is slightly higher than the desired frequency. Pulses are deleted from this frequency, perhaps at a slower point in the divider chain, at a rate such that the average output frequency is as close to a planned frequency as the timing increments allow. If the digital watch is running too fast, the user will cause pulses to be deleted at a faster average rate. Conversely, deleting fewer pulses on the average will speed up a slow watch.

In the operation of the digital watch, the recessed push button is depressed a predetermined number of times sequencing the watch through the months, date, hours, and minutes/seconds setting modes. An additional push of the recessed setting button puts the digital watch into the coarse frequency adjust mode and the letters "CFA" are displayed on the digital watch's display for approximately 1.0 second, then it goes blank for 0.5 second. Next, the display shows a three digit frequency correction number with the first two digits flashing. By holding down the main push button, the flashing number increments at a one Hertz rate until the desired coarse frequency correction number is obtained at which time the main push button is released, and the coarse frequency correction number is locked in. An additional push of the recessed push button will put the watch in the fine frequency adjust mode and the letters "FFA" are shown on the watch display for approximately one second. After a 0.5 second blank period, the watch displays the same three digit frequency correction number with the last digit flashing. By holding down the main push button, the flashing digit is incremented in a one Hertz rate until the desired fine frequency correction number is obtained, at which time the main push button is released and the fine correction number is locked in.

Figure 2:
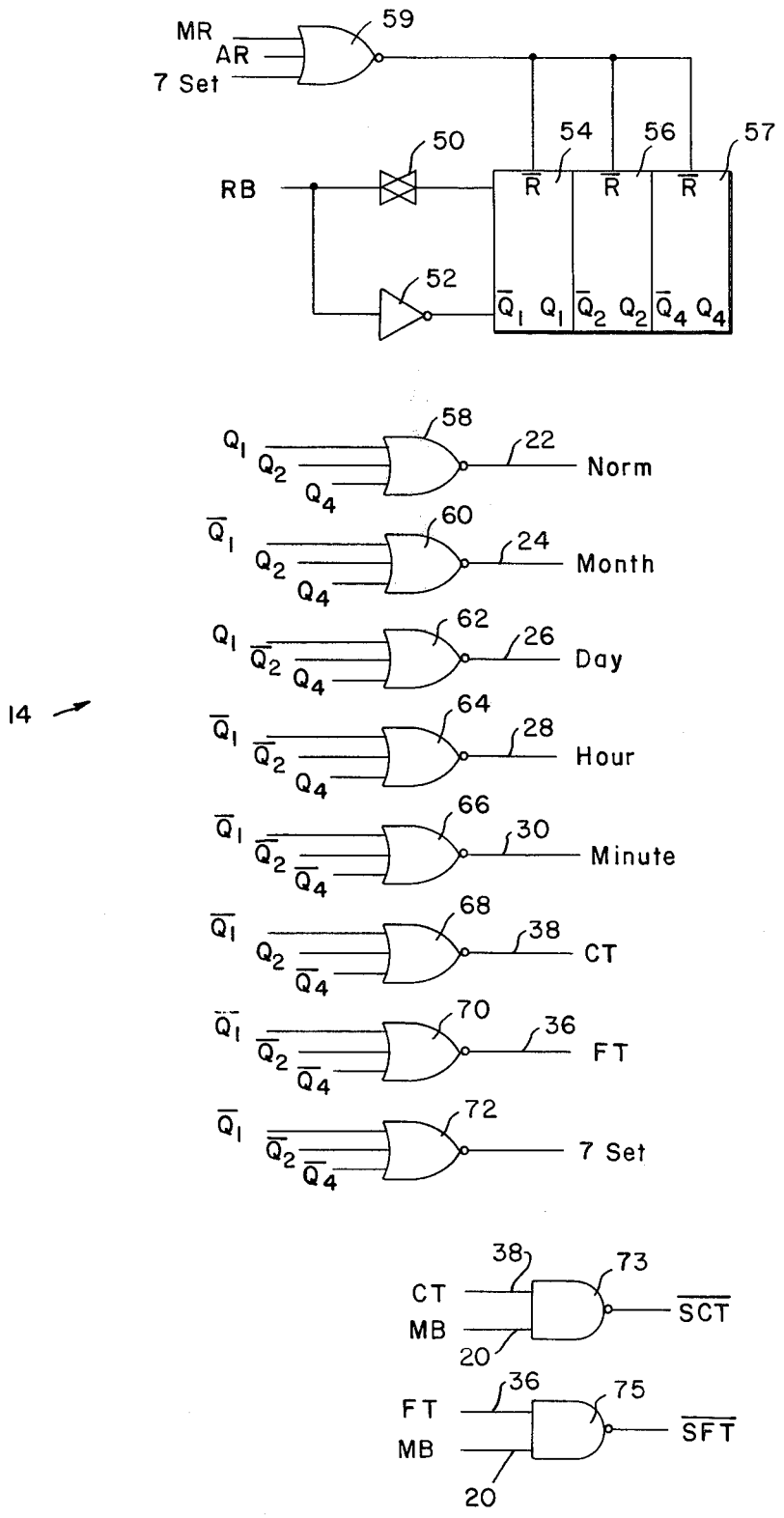
FIG. 2 is a schematic drawing of the setting logic circuit.

FIG. 2 shows the setting logic 14 of the frequency adjusting means 10. A signal corresponding to the debounced recessed push button is connected to the inputs of transmission gate 50 and inverter 52. These two elements form a two-phase clock generator for toggle flip-flop 54. (All the toggle flip-flops shown are negative edge sensitive.) Toggle flip-flop 54 has $Q_1$ and $\overline{Q}_1$ outputs. The outputs of flip-flop 54 are connected to the clocks of toggle flip-flop 56 which has outputs $Q_2$ and $\overline{Q}_2$. The outputs of flip-flop 56 are connected to the clocks of toggle flip-flop 57. Flip-flop 57 has two outputs $Q_4$ and $\overline{Q}_4$. The three flip-flops form a three-bit ripple up-counter. Each of the toggle flip-flops 54, 56 and 57 have a $\overline{\text{reset}}$ input connected to the output of NOR gate 59. NOR gate 59 has a plurality of inputs — a first input connected to a master reset, a second input connected to another reset, and a third input connected to a 7 SET. The setting logic 14 also has a set of NOR gates 58–72 which decode states 0–7. The first NOR gate 58 decodes state 0 and causes normal operation of the digital watch. NOR gate 60 decodes state 1 and causes the months information to be shown on the watch display and enabled for slew setting. NOR gate 62 decodes state 2 and causes the date information to be shown on the watch display and enabled for slew setting. NOR gate 64 decodes state 3 and causes the hours information to be shown on the display and enabled for slew setting. NOR gate 66 decodes state 4 and causes the minutes information to be shown on the watch display and enabled for slew setting. NOR gate 68 decodes state 5 and generates the coarse tune enable signal (CT) for the timer circuit 32. NOR gate 70 decodes state 6 and generates the fine tune enable signal (FT) for the timer circuit 32. Finally, NOR gate 72 decodes state 7 and creates "7 SET" which is delivered to the input of NOR gate 59 to reset the toggle flip-flops 54, 56 and 57 back to the normal state. Thus, the 8 state counter has one state deleted, leaving 7 states.

Setting logic 14 also contains a second set of gates; i.e., NAND gates 73 and 75. The first input to NAND gate 73 is the coarse tune enable signal from NOR gate 68. The second input 20 to NAND gate 73 is from the main push button 20. NAND gate 73 delivers a slew coarse tune inverse signal ($\overline{\text{SCT}}$) to the digital tuner 46. NAND gate 75 has as inputs the fine tune enable signal from NOR gate 70 and a main push button 20. NAND gate 75 delivers a slew fine tune inverse signal ($\overline{\text{SFT}}$) to the digital tuner 46.

Figure 3:
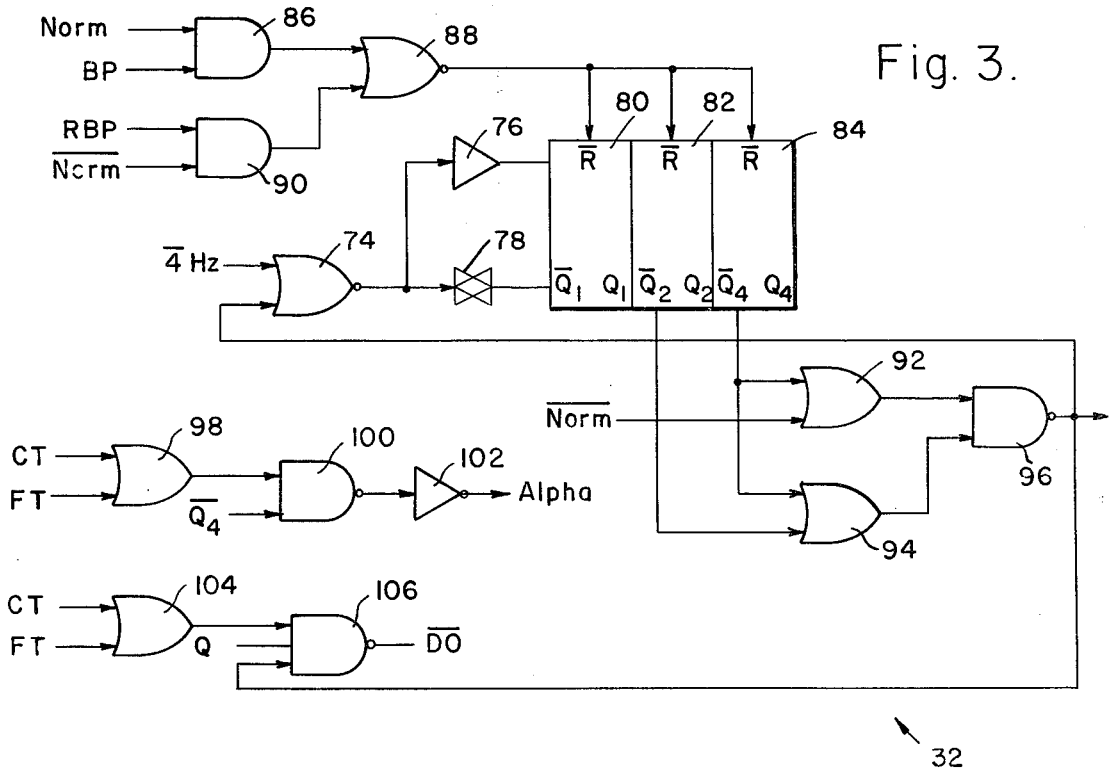
FIG. 3 is a schematic of the timer circuit.

Referring to FIG. 3, the timer circuit 32 has a NOR gate 74 which receives an inverted four Hertz pulse on its first input and its output is used to create two phase clocks for toggle flip-flop 80. The outputs of flip-flop 80 are connected to the clocks of flip-flop 82. The outputs of toggle flip-flop 82 are connected to the clocks of toggle flip-flop 84. Together they form a three bit ripple upcounter. AND gate 86 has two inputs; the first connected to the normal signal, the second connected to the button pushed (BP) signal. The output of AND gate 86 is connected to the first input to NOR gate 88. AND gate 90 has two inputs; the first connected to a pulse occurring upon the trailing edge of a recessed button push and the second connected to the inverse of the normal signal. The output of AND gate 90 is connected to the second input of NOR gate 88. The output of NOR gate 88 is connected to the $\overline{\text{reset}}$ input of toggle flip-flops 80, 82 and 84. The purpose of this resettable counter is to time normal button pushes and, in digital timing mode, to control display of letters and display blanking. Resetting the counter initiates a sequence. The $\overline{Q}$ output of toggle flip-flop 84 is connected to the first input to OR gates 92 and 94. The $\overline{Q}$ output of toggle flip-flop 82 is connected to the second input to OR gate 94. The second input to OR gate 92 is connected to the inverse of the normal signal. The output of OR gate 92 is connected to the first input of NAND gate 96. The output of OR gate 94 is connected to the second input to NAND gate 96. The output of NAND gate 96 is fed back to the second input of NOR gate 74. Its purpose is to stop the clock to the counter and provide a timed signal that is used to control the display. Gate 92 gives a one second time in normal operation. Gate 94 gives a $1\frac{1}{2}$ second time used in the digital tune mode.

The timer circuit 32 also contains OR gate 98 with its first input connected to the coarse tune enable signal and its second input connected to the fine tune enable signal and its output connected to a first input to NAND gate 100. The second input to NAND gate 100 is connected to the $\overline{Q}$ output of toggle flip-flop 84. The output of NAND gate 100 is connected to the input of inverter 102 and the output of inverter 102 delivers a signal ALPHA to the digital watch's display controlling circuitry. This signal ALPHA lasts one second and tells the digital watch either to display the alphabetical data, "CFA" which stands for coarse frequency adjust or "FFA" for fine frequency adjust depending upon which mode is desired, which is determined by the signals CT and FT.

Finally, the timer circuit contains OR gate 104 with its first input connected to the coarse tune enable signal (CT) and its second input connected to the fine tune enable signal (FT) and its output connected to a first input to NAND gate 106. The second input to NAND gate 106 is connected to the Q output from toggle flip-flop 84 and the third input to NAND gate 106 is connected to the output from NAND gate 96. The output of NAND gate 106 is the display off inverse ($\overline{\text{DO}}$) signal. This circuit causes a half second of blanked display after either the CFA or FFA letters have been displayed on the digital watch's display.

Figure 4:
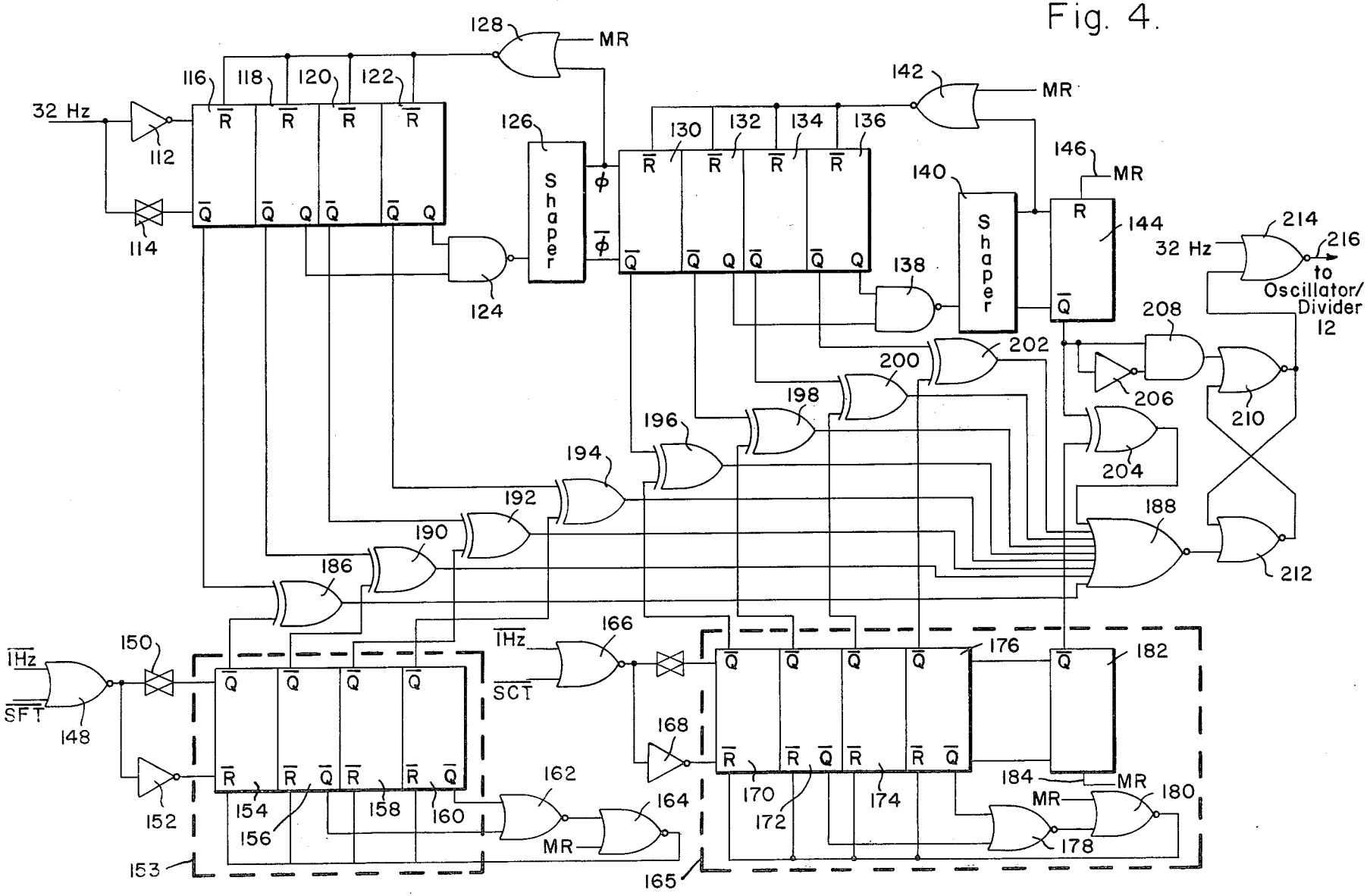
FIG. 4 is a schematic drawing of the digital tuner.

FIG. 4 shows the digital tuner 46 of the frequency adjusting means of the present invention. The digital tuner 46 receives a signal from divider 10 which is used to clock flip-flop 116. The outputs of toggle flip-flop 116 are connected to the clocks of toggle flip-flop 118, the outputs of toggle flip-flop 118 are connected to the clocks of toggle flip-flop 120 and the outputs of flip-flop 120 are connected to the clocks of toggle flip-flop 122. These elements thus form a four bit ripple up-counter. The Q output from flip-flop 118 is connected to a first input to NAND gate 124 and the second input to NAND gate 124 is connected to the Q output of toggle flip-flop 122. The output of NAND gate 124 is connected to the shaper (Hysteresis) circuit 126 for shaping the signal at this point. The first output from the shaper 126 is connected to a first input to NOR gate 128. The second input to the NOR gate is connected to the master reset signal and the output from NOR gate 128 is connected to the $\overline{\text{reset}}$ inputs on the toggle flip-flops 116–122. Thus, the counter is fed back so that it is a decade counter going continuously from 0 thru 9 and back to 0. The outputs from the shaper circuit 126 are connected to the clocks of toggle flip-flop 130. The outputs from flip-flop 130 are connected to the clocks of toggle flip-flop 132, the outputs of toggle flip-flop 132 are connected to the clocks of toggle flip-flop 134 and the outputs of flip-flop 134 are connected to the clocks of toggle flip-flop 136. The Q outputs of toggle flip-flop 136 is connected to a first input to NAND gate 138 and the Q output from toggle flip-flop 132 is connected to the second input to NAND gate 138. The output from NAND gate 138 is connected to the input to shaper circuit 140. The first output from shaper circuit 140 is connected to a first input to NOR gate 142 and to the first input to toggle flip-flop 144. The second input to NOR gate 142 is connected to the master reset signal and the output from NOR gate 142 is connected to the $\overline{\text{reset}}$ inputs to toggle flip-flops 130–136. This circuitry forms another decade counter. The outputs from shaper circuit 140 are connected to the clocks of toggle flip-flop 144. The reset input to toggle flip-flop 144 is connected to the master reset signal 146. In all, this circuitry forms a 200 state binary coded decimal (BCD) counter that counts from 000 to 199.

The first input to NOR gate 148 is connected to an inverted one Hertz pulse and the second input receives the slew fine tune inverse signal ($\overline{\text{SFT}}$) from setting logic 14. The output of NOR gate 148 is the clock of toggle flip-flop 154. Circuit 153, the fine tune portion of the digital tuner, consists of toggle flip-flops 154, 156, 158 and 160 which are connected as a ripple counter. The $\overline{Q}$ output from flip-flop 156 is connected to the first input to NOR gate 162 and the second input to NOR gate 162 is connected to the $\overline{Q}$ output from flip-flop 160. The first input to NOR gate 164 is connected to the master reset signal and the second input to NOR gate 164 is connected to the output from NOR gate 162. The output from NOR gate 164 is connected to the $\overline{\text{reset}}$ inputs to toggle flip-flops 154 through 160. This circuitry causes 153 to be a BCD counter. The coarse tune section 165 of digital tuner 44 consists of flip-flops 170, 172, 174 and 176 and logic that causes 165 to operate as a BCD decade counter. The first input to NOR gate 166 is an inverse one Hertz pulse signal. The second input to NOR gate 166 is the slew coarse tune inverse signal which is delivered from the setting logic 14. The output of NOR gate 166 is the clock of toggle flip-flop 170. Again, a 200 state BCD circuit with states from 000 to 199 is formed.

Exclusive OR gates 186–204 compare the $\overline{Q}$ outputs of the upper toggle flip-flops 116–122, 130–136 with the lower toggle flip-flops 154–160, 170–176 of the digital tuner 46. The outputs of these exclusive OR gates are inputed into NOR gate 188. When the inputs are all at a low binary level, a high binary level signal is delivered via the output of NOR gate 188 to the first input to NOR gate 212. The $\overline{Q}$ output from toggle flip-flop 144 and its delayed inverse are the inputs of AND gate 208. The output of AND gate 208 is a pulse that is inputed into a first input to NOR gate 210. NOR gates 210 and 212 are cross-coupled and form a latch which is set at the beginning of a cycle and reset when a match occurs. The output of NOR 210 is used to gate the 32 Hertz clock via line 216 back to the oscillator/divider 12. The number set into 153 and 165 determines the number of 32 Hertz pulses per 200/32 seconds delivered to the oscillator/divider 12. Thus, the counter determines the average rate at which pulses are deleted from the crystal oscillator frequency.

Figure 5:
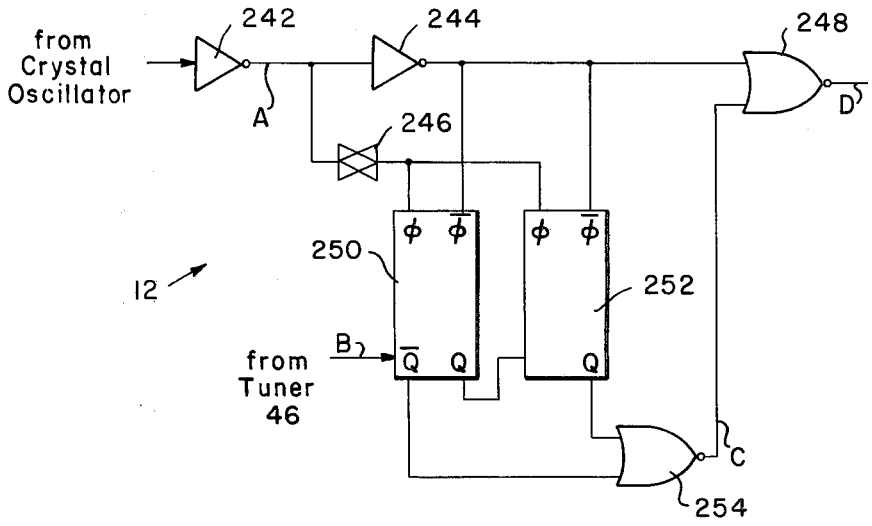
FIG. 5 is a schematic drawing of the pulse deletion circuit.

FIG. 5 is a detailed drawing of the oscillator/divider 12 of the present invention. A signal from an oscillator crystal is delivered through series inverters 242 and 244 to NOR gate 248 and through transmission gate 246 to static flip-flop 250 and to dynamic flip-flop 252. Inverters 242 and 244 are used to shape the square wave. The output of inverter 242 is connected to transmission gate 246. The output of inverter 244 is connected to a first input to NOR gate 248 and to the $\overline{\phi}$ inputs to static delay flip-flops 250 and dynamic delay flip-flop 252. The output of transmission gate 246 is connected to the $\phi$ inputs to the static and dynamic delay flip-flops 250 and 252, respectively. The $\overline{Q}$ output from static flip-flop 250 is connected to a first input to NOR gate 254 and the Q output from static flip-flop 250 is connected to the input to dynamic flip-flop 252. The Q output from dynamic flip-flop 252 is connected to the second input to NOR gate 254 and the output from NOR gate 254 is connected to the second input to NOR gate 248.

The circuitry as shown in FIG. 5 will delete a pulse upon the positive going edge of the controlling input. In this example, the oscillator runs slightly over 786,432 Hertz, but pulses are deleted at the 98K Hertz point because of speed and power considerations.

Figure 6:
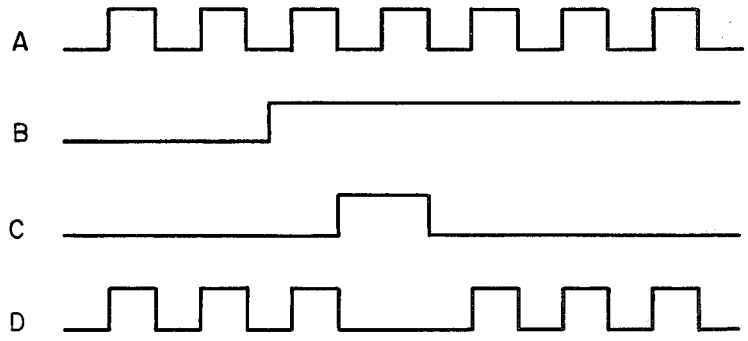
FIG. 6 shows waveforms illustrating the operation of the pulse deletion circuit of FIG. 5.

The waveforms of FIG. 6 show the operation of the circuitry of FIG. 5. Waveform A is the output of the dynamic dividers 240 at point A of FIG. 5. Waveform B is the input to flip-flop 250 from the digital tuner 46. When the signal at point B (of FIG. 5) goes to a high binary level, a pulse is deleted from the pulse train at point D of FIG. 5. Waveform C, at the output of NOR gate 254, goes high when waveform B is high and when waveform A goes low (on the trailing edge of waveform A). Finally, waveform D, the output of NOR gate 248, is the NOR of waveforms $\overline{A}$ and C.

Although the device which has just been described appears to afford the greatest advantages for implementing the invention, it will be understood that various modifications can be made thereto without going beyond the scope of the invention, it being possible to replace certain elements by other elements capable of fulfilling these same technical function therein.

What is claimed is:

1. In a device requiring a fixed frequency, a frequency adjusting system for subtracting pulses from a wavetrain to obtain a predetermined frequency of sufficient accuracy, said means comprising:

an oscillator for providing a wavetrain at a constant frequency that is slightly higher than a predetermined value;

logic means, connected to receive said wavetrain from said oscillator, for removing pulses from the oscillator wavetrain;

manually operable means, connected to said oscillator, for controlling the removal of pulses, said means being programmable to change the average rate of pulse removal in accordance with a correction factor having a plurality of individually alterable portions;

an electro-optical display, connected to said logic means, for displaying data indicating the average rate of pulse removal, said display indicating alphabetically the portion of the correction factor available for alteration before displaying the actual correction factor.

2. In a digital watch having a crystal oscillator/divider chain and a display, a frequency adjusting system for subtracting pulses in the crystal oscillator/divider chain to obtain a predetermined frequency, said system comprising:

a crystal oscillator for providing a constant frequency slightly higher than a predetermined value;

first and second push buttons;

setting logic for sequencing the digital watch through a plurality of states in response to successive actuations of said first push button, different horological information being available for setting and for alteration of a frequency correction factor in respective ones of said states;

a timer circuit connected to said setting logic for causing a plurality of letters to be displayed for a short period of time on the digital watch when said first push button is depressed to cause an advance to a state where said frequency correction factor alteration is enabled to indicate that fact before displaying the numerical correction factor;

said second push button being connected to said setting logic, and said setting logic including means for incrementing the frequency correction number at a one Hertz rate in response to depression of said second push button until said push button is released; and a user adjustable digital tuner connected between said setting logic and said oscillator for subtracting pulses from the frequency generated by said oscillator.

3. The frequency adjusting means of claim 1 wherein, said first push button is a recessed push button.

4. The frequency adjusting means of claim 1 wherein, said setting logic comprises:

a plurality of flip-flops having an input and a plurality of outputs;

a first set of gates having inputs and outputs;

said input of said first flip-flop connected to said recessed push button, said outputs of said flip-flops connected to said inputs of said first set of gates;

said outputs of said gates connected to the digital watch display circuitry;

a second set of gates having a plurality of inputs and an output;

said first input of said second set of gates connected to said second push button, said second input connected to said output of one of said first sets of gates; and some of said outputs of said second set of gates connected to said digital tuner.

5. The frequency adjusting means of claim 1 wherein, there are two states for frequency adjustments, coarse and fine.

6. The frequency adjusting means of claim 5 wherein, the letters displayed are CFA (coarse frequency adjustment) and FFA (fine frequency adjustment).

7. The frequency adjusting means of claim 1 wherein, said frequency correction number is divided into two portions, and the portion enabled for incrementation is flashing while the other portion is not flashing.

8. The frequency adjusting means of claim 1 wherein, said digital tuner comprises:

a first set of counters driven continuously from the divider circuitry;

a second set of counters that the user may increment;

a plurality of gates between said first and second sets of counters for determining the average rate at which pulses are to be removed; and a circuit to remove pulses from a wavetrain upon command from said plurality of gates.

* * * * *